United States Patent [19]

Gessinger

[11] 4,110,131

[45] Aug. 29, 1978

[54] METHOD FOR POWDER-METALLURGIC PRODUCTION OF A WORKPIECE FROM A HIGH TEMPERATURE ALLOY

[75] Inventor: Gernot Gessinger, Bublikon, Switzerland

[73] Assignee: BBC Brown Boveri & Company, Limited, Baden, Switzerland

[21] Appl. No.: 732,753

[22] Filed: Oct. 15, 1976

[30] Foreign Application Priority Data

Oct. 20, 1975 [CH] Switzerland ..... 13558/75

[51] Int. Cl.[2] ..... C22F 1/10

[52] U.S. Cl. ..... 148/11.5 N; 29/420.5; 29/417; 75/200; 75/211; 75/226; 148/11.5 P; 148/126

[58] Field of Search ..... 75/200, 226, 211; 29/420.5, 417; 72/338; 148/11.5 R, 126, 11.5 N, 11.5 P

[56] References Cited

U.S. PATENT DOCUMENTS

| | | | |
|---|---|---|---|
| 3,420,716 | 1/1969 | Slepitis | 148/11.5 N |
| 3,776,704 | 12/1973 | Benjamin | 75/226 X |
| 3,823,463 | 7/1974 | Weaver et al. | 29/417 |
| 3,865,575 | 2/1975 | Volin et al. | 75/0.5 R |
| 3,975,219 | 8/1976 | Allen et al. | 148/11.5 N X |
| 3,976,482 | 8/1976 | Larson | 75/211 |

*Primary Examiner*—Richard E. Schafer

*Attorney, Agent, or Firm*—Oblon, Fisher, Spivak, McClelland & Maier

[57] ABSTRACT

A method for powder metallurgical production of a high temperature alloy body consists of mixing powdered alloy components or pre-alloys in the desired proportions; cold working the mix under a protective atmosphere; canning the cold-worked powder mixture; compressing the canned powder by extrusion or hot isostatic pressing to a form of dense blank; cutting said blank into slices; forging them at a constant temperature within the range of from 0.6 to 0.75 of the melting point at a strain rate of from $10^{-3}$ to $10^{0}$ $S^{-1}$; and thereafter subjecting the forged body to a coarse-grain annealing between 1230° and 1300° C for up to 3 hours.

9 Claims, 1 Drawing Figure

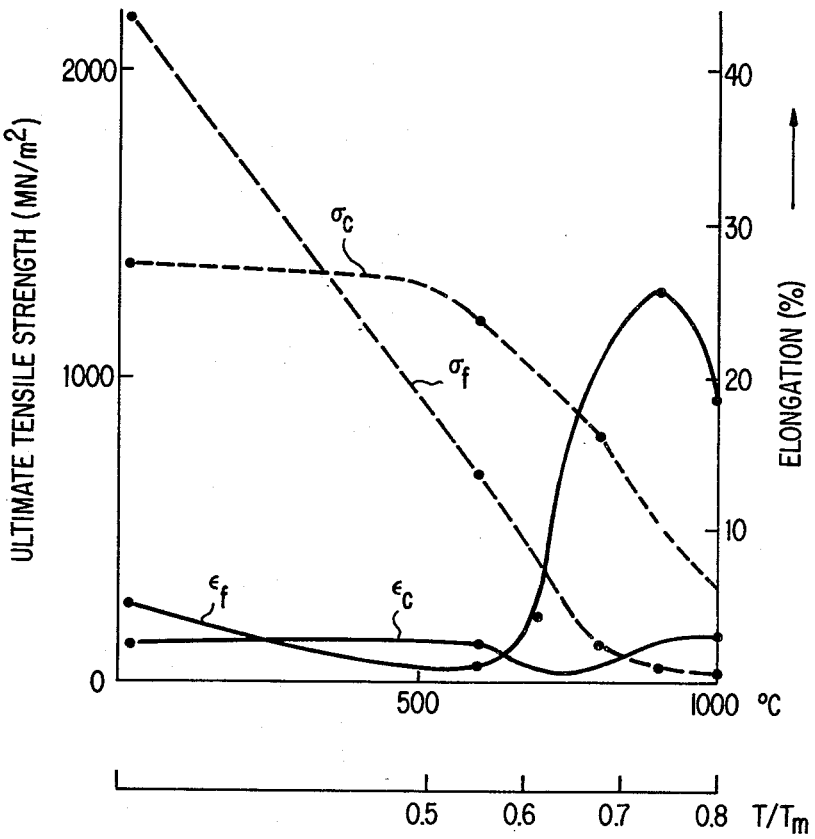
ULTIMATE TENSILE STRENGTH (MN/m²)
2000
1000
0
500
1000 °C
ELONGATION (%)
40
30
20
10
σc
σf
εf
εc
0.5
0.6
0.7
0.8
T/Tm

METHOD FOR POWDER-METALLURGIC PRODUCTION OF A WORKPIECE FROM A HIGH TEMPERATURE ALLOY

BACKGROUND OF THE INVENTION

1. Field of the Invention

The present invention is concerned with a method for powder-metallurgic production of a workpiece from a high-temperature alloy.

2. Description of the Prior Art

In the past, powders in the form of pre-alloys and/or alloy components have been mixed and cold work-hardened and from the mixed and cold work-hardened powders a billet produced by compression. From this product, a workpiece has been formed and subjected to a coarse-grain annealing. Such a method is disclosed, for example, in J. S. Benjamin, Metallurgical Transactions, Vol. I, 1970, p. 2943, and workpieces of particularly high creep strength are obtained thereby. More specifically, the steps involved in the Benjamin process are as follows:

(a) powder mixing;
(b) cold working in an attritor under a protective atmosphere;
(c) canning;
(d) extrusion below the recrystallization temperature; and
(e) coarse grain annealing.

The final product is a rod which cannot be further worked to obtain the form of a forged or cast workpiece otherwise than by grinding.

It is known further (DT-AS 1,923,524) to prepare forged parts from high temperature alloys by first forming a powder - or fusion-metallurgically produced billet in the proportion of at least 4:1 by extrusion pressing. The pressing is done in a temperature range extending from 250° C. below the recrystallization temperature up to the recrystallization temperature. The pressed billet is forged between 760° C. and the recrystallization temperature and then is subjected to a solution treatment above the recrystallization temperature, which is equivalent to a coarse-grain annealing. This method is costly since the billet is first produced from a melt or by sinter metallurgy and this billet must be worked by special processing before being forged.

SUMMARY OF THE INVENTION

Accordingly, it is an object of this invention to enable the forging of high temperature alloys at low cost without the need for grinding.

Briefly, this and other objects of the invention as will hereinafter become clear have been attained by providing a method for powder-metallurgic production of a high temperature alloy body which consists of mixing powdered alloy components or prealloys in the desired proportions; cold working the mix under a protective atmosphere; canning the cold-worked powder mixture; compressing the canned powder by extrusion or hot isostatic pressing to form a dense blank; cutting said blank into slices; forging them at a constant temperature within the range of from 0.6 to 0.75 of the melting point at a strain rate of from $10^{-3}$ to $10^{0}$ $S^{-1}$; and thereafter subjecting the forged body to a coarse-grain annealing between 1230° and 1300° C. for up to 3 hours. The final product is a finished workpiece which does not need further machining (for instance by grinding).

BRIEF DESCRIPTION OF THE DRAWINGS

A more complete appreciation of the invention and many of the attendant advantages thereof will be radily obtained as the same becomes better understood by reference to the following detailed description when considered in connection with the accompanying drawings, wherein:

The FIGURE illustrates the relationship of tensile strength and elongation versus T and T/Tm, respectively, for the prior art Benjamin alloy and that of this invention.

DESCRIPTION OF THE PREFERRED EMBODIMENTS

The steps in the process of this invention may be summarized as follows:

(a) powder mixing;
(b) cold working in an attritor under a protective atmosphere;
(c) canning;
(d) compression of the cannedpowder by
  (1) extrusion below the recrystallyzation temperature; or
  (2) hot isostatic pressing;
(e) cutting of the workpiece;
(f) forging at constant temperature (isothermal); and
(g) coarse grain annealing.

The alloy to be used in this invention can be any conventional high temperature alloy. Especially preferred are high temperature oxide-dispersion-hardened alloys and high temperature oxide-dispersion-free alloys. The alloys can be in any powdered form conventional for alloy components and pre-alloys. The main step of this invention consists of a forging treatment at constant temperature (isothermal). The basic concept is illustrated in the FIGURE where the ultimate tensile strength and the elongation of a superalloy are plotted against the temperature and the temperature ratio T/Tm, respectively. Tm represents the melting point. The graph shows two types of typical curves. One is for material in the fine-grained state ($\sigma_f$;$\epsilon_f$) and one for grain-coarsened material ($\sigma_c$;$\epsilon_c$). The coarse-grain annealed material according to Benjamin shows a high tensile strength ($\sigma_c$) and a very low elongation ($\epsilon_c$) within the temperature range of 0.6 to 0.75 Tm, the latter being the melting point of the alloy. Typically this range is from 700° to 800° C. In this particular case, the alloy is the oxide-dispersion-hardened alloy IN 738 + 1.5% $Y_2O_3$ and the corresponding temperature range is 700° to 800° C. Such a material is not workable other than by grinding. On the other hand, the fine-grained material of this invention shows a considerable decrease in tensile strength ($\sigma_f$) and a very sharp increase in elongation ($\epsilon_f$) between 700° and 800° C., i.e., becomes ductile and suitable for further deformation. By applying the forging techniques and conditions of this invention, this fine-grained microstructure is preserved during the deformation process. All specimens have been tested with a strain rate of $4.4 \times 10^{-3}$ $s^{-1}$, i.e., 0.44% elongation per second. However, the deformation speed is not very critical and a strain rate range of from $10^{-3}$ to $10^{0}$ $s^{-1}$, i.e., from 0.1% to 100% elongation per second, preferably from $10^{-3}$ to $10^{-2}s^{-1}$ may be adopted. The forging temperature should be held constant (isothermal) during the process and be held within the given limits.

By using this forging process, which takes place at temperatures considerably below the recrystallization point of the alloy, the driving force for subsequent recrystallization during the last heat-treatment step involving coarse-grain annealing is also preserved. This fact is essential because a coarse grained microstructure is indispensable for the final workpiece. One of the main difficulties for application of superalloys consists in obtaining on the one hand a good workability during the shaping and molding steps and on the other hand the ability to achieve a coarse microstructure in the end product. This problem is solved for wrought alloys by the present invention.

Having generally described the invention, a more complete understanding can be obtained by reference to certain specific examples, which are included for purposes of illustration only and are not intended to be limiting unless otherwise specified.

EXAMPLE I

The following powdered ingredients
Co: 8.5%
Cr: 16.0%
Mo: 1.75%
W: 2.60%
Ta: 1.75%
Nb: 0.09%
Al: 3.40%
Ti: 3.40%
B: 0.01%
Zr: 0.01%
Ni: 60.0%
$Y_2O_3$: 1.5% were mechanically alloyed under argon for 40 hours in a Netzsch Co. S-1 attritor and thereby cold-worked. The total amount of the combined powder was 1000 grams. The volume ratio of steel balls/powder in this step was 1/9. The powder was then drawn off into soft-iron capsules and the capsules welded shut. The encapsulated powder was heated to 1100° C. and extrusion-pressed in the reduction ratio of 20:1. Cylindrical slices 40 mm high were taken from the extrusion product and pressed in a forging die to a thickness of 10mm with about 60kg/mm$^2$ pressure at a temperature of 700° to 800° C. Next, the slices were subjected to a coarse-grain annealing at 1275° C. for 3 hours. The breaking elongation of tensile test rods made from the slices was 3.1% at 1100° C. and the breaking stress was 117.4 kg/mm$^2$. The same result was obtained when the powder, instead of being extrusion pressed, was consolidated in a hot isostatic press at 1050° C. for 1 hour at a pressure of 3000 bars.

EXAMPLE 2

The following powdered ingredients
Co: 8.5%
Cr: 16.0%
Mo: 1.75%
W: 2.60%
Ta: 1.75%
Nb: 0.09%
Al: 3.40%
Ti: 3.40%
B: 0.01%
Zr: 0.10%
Ni: 60.00%
C: 0.17% were mechanically alloyed under argon in a Netzsch Co. S-1 attritor for 40 hours and thereby cold worked. The total amount of combined powder was 1000 grams. The volume ratio of steel balls/powder was 1/9. The powder was drawn off into soft-iron capsules and the capsules were welded shut. The encapsulated powder was heated to 1100° C. and extrusion pressed in the reduction ratio 20:1. Cylindrical slices 40 mm high were taken from the extrusion product and compressed to 10 mm in thickness in a forging die at a temperature of 700° to 800° C. and a pressure of about 60 kg/mm$^2$. Then the slices were subjected to a coarse-grain annealing at 1275° C. for three hours. The breaking elongation of tensile test rods made from the slices was 5% at 1100° C. and the breaking stress was 50.2 kg/mm$^2$.

The same result was obtained when the powder, instead of being extrusion pressed, was consolidated by hot isostatic pressing at 1050° C for 1 hour at a pressure of 3000 bars.

EXAMPLE 3

The following powdered ingredients
Cr: 19%
Al: 1.2%
Ti: 2.4%
Zr: 0.07%
B: 0.07%
Ni: 77.0% were mechanically alloyed and cold worked under argon in a Netzch Co. S-1 attritor for 40 hours. The total amount of combined powder was 1000 grams. The volume ratio of steel balls/powder was 1/9. The powder was drawn off into soft iron capsules and the capsules welded shut. The encapsulated powder was heated to 900° C. and compressed to a solid body in a hot isostatic press at 3000 bars for one hour. Cylindrical slices 40 mm high were taken from the resultant piece and compressed to 10 mm in thickness in a forging die at a temperature between 700° and 800° C. and a pressure of about 40 kg/mm$^2$. Then the slices were subjected to a coarse-grain annealing at 1240° C. for 3 hours. The breaking elongation of tensile test rods made from the slices was 4.5% at 1100° C. with a breaking stress of 95 kg/mm$^2$.

EXAMPLE 4

The following powdered ingredients
Co: 15.0%
Cr: 10.0%
Al: 5.5%
Ti: 4.7%
Mo: 3.0%
C: 0.02%
B: 0.15%
Zr: 0.06%
Ni: 61.50% were mechanically alloyed and thereby cold worked under argon in a Netzsch Co.S-1 attritor for 40 hours. The total amount of the combined powder was 1000 grams. The volume ratio of steel balls/powder was 1/9. The powder was drawn off into soft iron capsules and the capsules welded shut. The encapsulated powder was hot-isostatically compressed to a solid body at 900° C. for an hour at 3000 bars. Cylindrical slices 40 mm high were taken from the resultant piece and compressed to a thickness of 10 mm in a forging die at a temperature between 700° and 800° C. and a pressure about 60 kg/mm$^2$. Then the slices were subjected to a coarse-grain annealing at 1290° C. for 30 minutes. The breaking elongation of tensile test rods made from the slices was 3.5% at 1100° C. with a breaking stress of 100 kg/mm$^2$.

The tests show that in all cases the achieved creep and tensile strengths at high temperatures were just as high as those achieved without the intermediate forging process.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method for powder metallurgical production of a high temperature alloy body which consists of mixing powdered alloy components or pre-alloys in the desired proportions; cold working the mix under a protective atmosphere; canning the cold-worked powder mixture; compressing the canned powder by extrusion or hot isostatic pressing to form a dense blank; cutting said blank into slices; forging them at a constant temperature within the range of from 700-800° C. at a strain rate of from $10^{-3}$ to $10^{-2}$ $S^{-1}$; and thereafter subjecting the forged body to a coarse-grain annealing between 1230° and 1300° C. for up to 3 hours.

2. The method of claim 1, wherein the compression of the canned powder mixture is effected by extrusion between 1050° C. and 1150° C.

3. The method of claim 1, wherein the compression of the canned powder mixture is effected by hot isostatic pressing at a temperature above 900° C. and at a pressure of 3000 bars.

4. The method of claim 1, wherein the blank is forged from a hightemperature oxide-dispersion-hardened alloy.

5. The method of claim 4, wherein a blank having the the composition: 8.5% Co, 16.0% Cr, 1.75% Mo, 2-.60% W, 1.75% Ta, 0.09% Nb, 3.40% Al, 3.40% Ti, 0.01% B, 0.01% Zr, 60.0% Ni, and 1.5% $Y_2O_3$ is forged.

6. The method of claim 1, wherein the blank is forged from a high-temperature oxide-dispersion-free alloy.

7. The method of claim 6, wherein a blank having the composition 8.5% Co, 16.0% Cr, 1.75% Mo, 2.60% W, 1.75% Ta, 0.09% Nb, 3.40% Al, 3.40% Ti, 0.01% B, 0.10% Zr, 60.0% Ni and 0.17% C is forged.

8. The method of claim 6, wherein a blank having the composition 19.0% Cr, 1.2% Al, 2.4% Ti, 0.07% Zr, 0.07% B and 77.0% Ni is forged.

9. The method of claim 6, wherein a blank having the composition 15.0% Co, 10.0% Cr, 5.5% Al, 4.7% Ti, 3.0% Mo, 0.02% C, 0.15% B, 0.06% Zr and 61.5% Ni is forged.

* * * * *